US005511274A

United States Patent [19]

Lewis, Jr.

[11] Patent Number: 5,511,274

[45] Date of Patent: Apr. 30, 1996

[54] INTEGRALLY FUSED BRUSH CONSTRUCTION

[75] Inventor: John C. Lewis, Jr., Salisbury, Vt.

[73] Assignee: Tucel Industries, Inc., Forest Dale, Vt.

[21] Appl. No.: 137,537

[22] Filed: Oct. 18, 1993

[51] Int. Cl.[6] ..... A46B 7/02; A46B 3/04; A46B 15/00

[52] U.S. Cl. ..... 15/160; 15/159.1; 15/203; 15/185; 15/201; 15/187; 15/172; 300/21

[58] Field of Search ..... 15/159.1, 160, 15/201, 203, 171, 172, 186, 187, 188; 300/21

[56] References Cited

U.S. PATENT DOCUMENTS

| | | | |
|---|---|---|---|
| 581,919 | 5/1897 | Proskauer | 15/201 |
| 1,958,134 | 5/1934 | Dike | 15/160 |
| 2,604,649 | 7/1952 | Stephenson et al. | 15/201 |
| 2,958,889 | 11/1960 | Greenblatt | 15/187 |
| 3,584,328 | 6/1971 | Lechene et al. | 15/187 |
| 3,604,043 | 9/1971 | Lewis, Jr. | 15/159 |
| 4,057,867 | 11/1977 | Ballin | 15/203 |
| 4,189,189 | 2/1980 | Lewis, Jr. | 300/7 |
| 4,291,431 | 9/1981 | Lewis, Jr. | 15/159 |
| 4,348,060 | 9/1982 | Lewis, Jr. | 30/21 |
| 4,690,277 | 9/1987 | Lewis, Jr. | 15/167.1 |
| 4,693,519 | 9/1987 | Lewis, Jr. | 300/7 |
| 4,908,902 | 3/1990 | McNab et al. | 15/159.1 |
| 4,988,146 | 1/1991 | Weihrauch | 300/21 |
| 5,114,214 | 5/1992 | Barman | 300/21 |
| 5,224,763 | 7/1993 | Dirksing | 300/21 |

FOREIGN PATENT DOCUMENTS

| | | | |
|---|---|---|---|
| 1223871 | 2/1960 | France | 15/187 |
| 937765 | 1/1956 | Germany | 15/186 |

*Primary Examiner*—Gary K. Graham
*Attorney, Agent, or Firm*—Lowe, Price, LeBlanc & Becker

[57] ABSTRACT

There is disclosed therein a tufted construction formed of a thermoplastic sheet which defines a two-dimensional projection of a three-dimensional tufted construction design which has integrally mutually spaced prefused tufts mounted at preselected areas on one surface thereof. The three-dimensional design includes a radial surface having said tufts thereon and a handle portion so that when the projection is assembled and the edges thereof joined, the three-dimensional design will be complete.

4 Claims, 8 Drawing Sheets

INTEGRALLY FUSED BRUSH CONSTRUCTION

BACKGROUND OF THE INVENTION

1. Field of the Invention

This invention relates to the manufacture of fused brushware products and, preferably, to such products which are constructed of a single raw material so that the finished product may be recycled when it is no longer functional. The brushware product is intended to be constructed from a minimum of material and provide brush tufts radiating inwardly or outwardly from a curved surface.

2. Description of the Prior Art

Many different types of brushes have been devised over the years from an original tree branch or shrub branch, and developing into wire-set, anchor-set, staple-set, twisted-in-wire and resin-set designs. These designs include both natural and synthetic filament materials. There was also developed a method of fusing like materials such as polypropylene monofilament into a molded section of polypropylene to form a basic brushware configuration. Many prior patents invented by John C. Lewis, Jr., the inventor herein, disclose different variations and improvements in this overall concept. Representative of such patents are U.S. Pat. Nos. 3,604,043; 4,189,189; 4,291,431; 4,348,060; 4,690,277; and 4,693,519, the disclosures of which are hereby incorporated by reference. These patents in general disclose tufted fused brush construction and mat-like devices wherein synthetic filament tufts are fused to molded base sections. There is no disclosure, however, therein of a brush or broom construction which can be obtained from a flat mat projection of the resulting three-dimensional object. The patents do disclose methods for tufting articles which methods are used to form the constructions of this invention.

In U.S. Pat. No. 5,114,214, there is described an effort to make a toothbrush having tufts set in brush sections which are separated by attenuation grooves. The patent describes a process for heating the grooves so that the brush sections may be bent to form a radial or other type of surface wherein each section is disposed at an angle to adjacent sections but each individual section is contained in a single plane. Also in U.S. Pat. No. 5,224,763 and 4,988,146 there are described different means for forming a brush construction wherein the tuft end is melted and then set in a cavity of heat-softened material. In U.S. Pat. No. 5,224,763, a collar is provided around the cavity which, in turn, is swaged to secure the tuft in the cavity. Also, in U.S. Pat. No. 4,988,146, the cavity is heat softened and may be formed in a variety of different geometric designs. These patents, however, also do not describe the means for making a three-dimensional body from a flat sheet projection.

SUMMARY OF THE INVENTION

It has been discovered, however, that a unique brush type construction can be formulated by providing a base which is a flat projection of the desired three-dimensional object to be formed so that tufts may be mounted on said base and the base then folded into the desired three-dimensional configuration. Such a construction then minimizes the amount of material necessary to form the construction, and in using tufts and bases of the material, the end result may be readily recycled when its useful life is finished. The formed device of this invention then may have tufts radiating inwardly or outwardly depending upon the desired result and is preferably made of polypropylene resin. While it is desired to use a tuft of monofilaments and a base of the same material, if necessary, this invention is intended to include constructing brush constructions of dissimilar materials such as a polypropylene molded base having a polyester monofilament fused construction thereon.

The improved device of this invention generally includes an integrally molded hand placement area, handle, or attachment means, in order to use the brushware effectively and a predetermined tuft configuration allowing for the most efficient brushing action which can be achieved. The tuft construction is on a radial surface which, in general, either radiates inwardly or outwardly. Less raw material and energy are employed during manufacture because the three-dimensional object is formed from a flat projection thereof with assembly occurring by attachment of an attachment device at the edges of the projection.

Accordingly, it is an object of this invention to provide an integral one-piece fused filament grip or handle-cleaning device which is self-supporting and can be used manually, or machine driven.

It is another object of this invention to provide a single component recyclable non-polluting brush or broom construction costing less to manufacture due to the use of a minimum amount of raw materials.

It is a further object of this invention to provide a grip or handle cleaning device which has a tuft configuration in radial form which configuration is formed on a flat projection of the three-dimensional cleaning device;

It is still another object of this invention to provide a tufted cleaning surface on a device which maximizes the contact between the shape of the unit and the object to be cleaned; and It is yet another object of this invention to provide a brushware construction having a predetermined configuration which can be altered or changed during use by merely changing the attachment of the integral mat section and handle.

These and other objects will become readily apparent with reference to the drawings and following descriptions wherein:

DETAILED DESCRIPTION OF THE PREFERRED EMBODIMENTS

Figure 1:
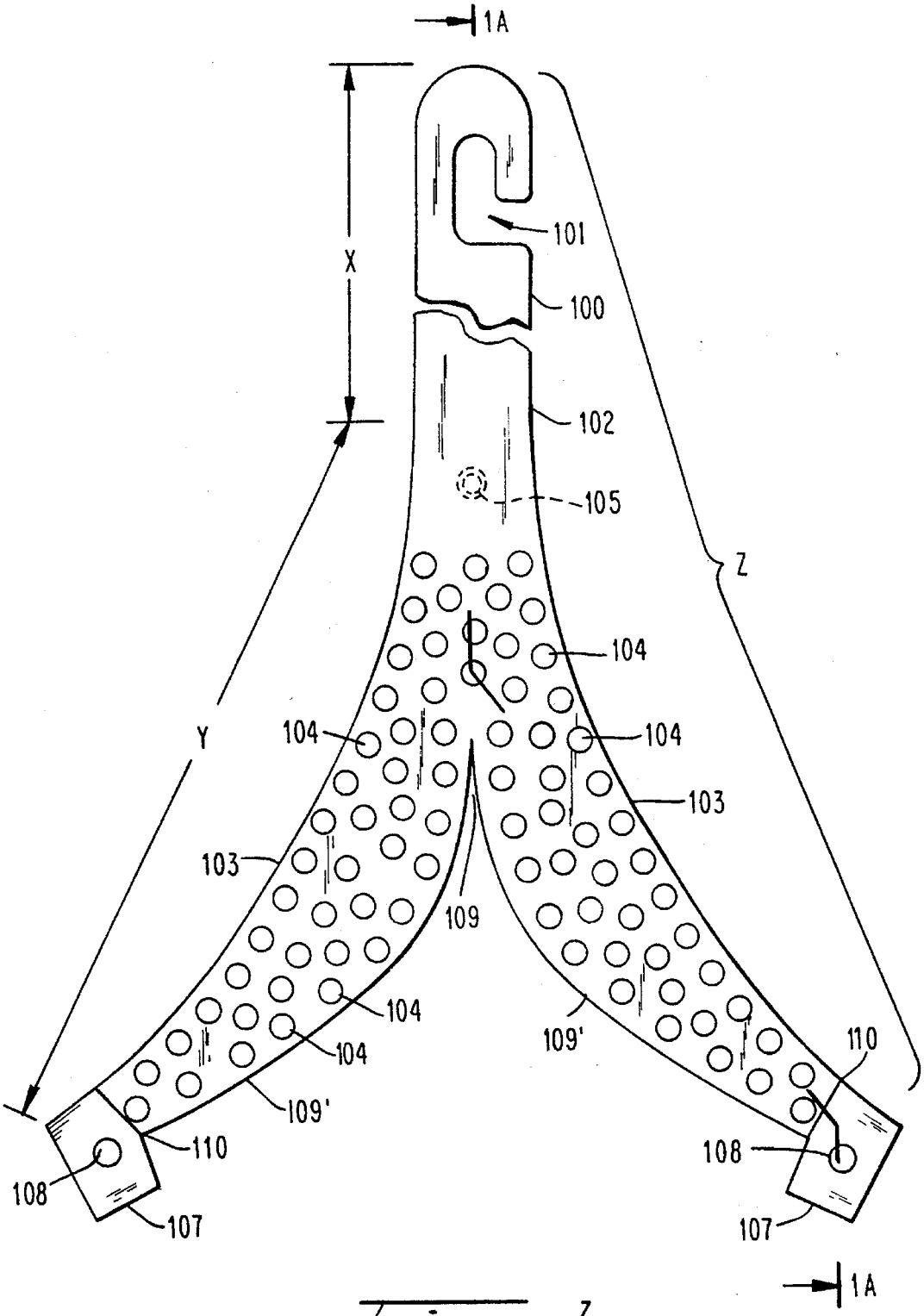
FIG. 1 is a top view of the unassembled one-plane molded handle/filament support member of this invention before mounting tufts thereon.
Figure 2:
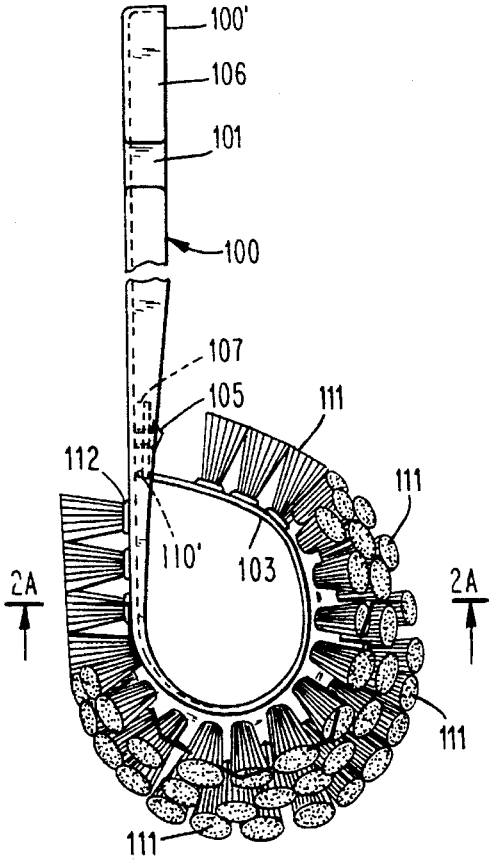
FIG. 2 is a side view of the fused handle/filament support of FIG. 1B after assembly.

A brushware device 100' of the instant invention is shown in FIG. 2. The device is made by first molding a thin, flat, thermoplastic one-dimensional sheet 100 of FIG. 1 comprising a handle extension 102, hang-up hook 101, two configured filament accepting sections 103 radiating outward from handle 102 at point 109 with raised designated filament fusing bases 104. The sheet 100 may be no more than 0.035 inches thick and the bases 104 may be 0.08 to 0.09 inches thick including the thickness of the base sheet 100. An assembly tab means 105 is provided to accept the hole means 108 located on extensions 107 at each section 103 attached thereto by means of a molded "living hinge" 110. The pre-brushware device sheet 100 of FIG. 1 generally has an overall length of "Z" with the handle section 102 being of a length designated by "X" while the configured sections 103 generally can have both shape and length of "Y".

Figure 1A:
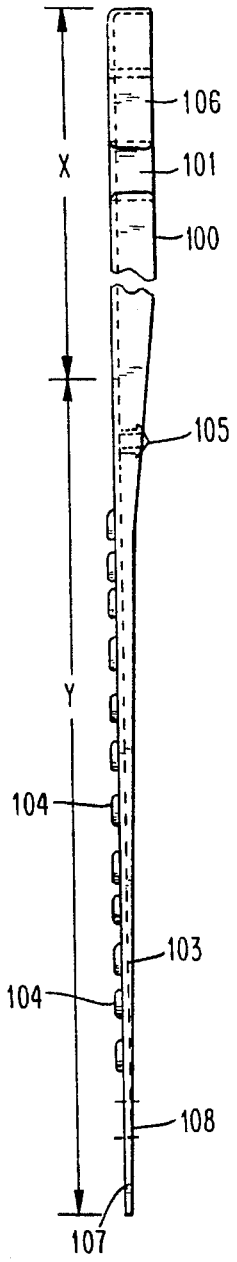
FIG. 1A is an unassembled side view of the device of FIG. 1 taken along lines 1A—1A.
Figure 1B:
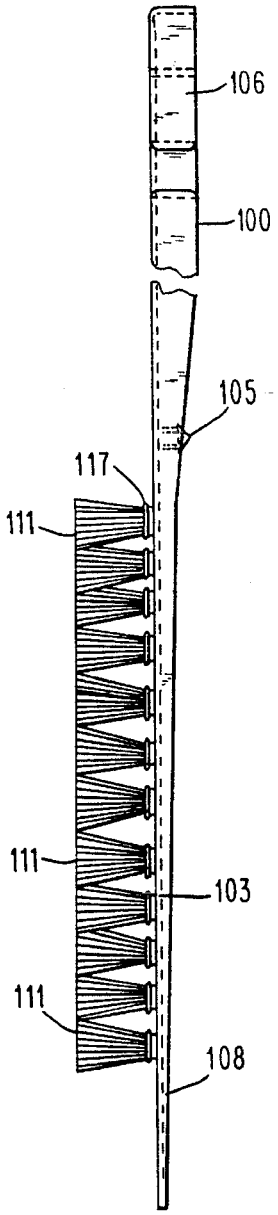
FIG. 1B is an unassembled side view of the handle/filament support of FIG. 1 after fusing synthetic filament tufts thereon.

FIG. 1A illustrates the flatness and designated lengths of each section of the molded sheet 100 prior to picking and fusing filament to the raised base sections 104, while FIG. 1B shows the fused sheet 100 with filament tufts 111 as fused at the base at 112. By using the tufting process of the above Lewis patents, the tuft device of FIG. 1B remains flat as shown even with a base sheet 100 having a thickness of 0.035 inches. The attachment means 105 can be seen extending downward from the handle section 102. Also, handle section 102 can be molded so as to have a more substantial configuration 106, without sacrificing the overall generally thin configuration of sheet 100.

Figure 2A:
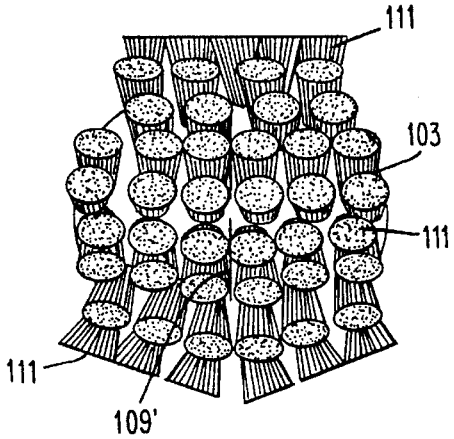
FIG. 2A is a view taken along lines 2A—2A of FIG. 2.

FIG. 2 illustrates the actual brushware, in this case, a toilet bowl brush 100' as created from sheet 100 with the extended fused filament sections 103 bent around in a manner as to allow the sections 107 with hole means 108 to be located onto assembly means 105, with the "living hinge" 110 flexed at 110 to allow the assembly into said brushware 100'. FIG. 2A illustrates the three-dimensional view of the filament tufts 111 spread in a normal brush pattern as radiating from base 103 as taken through lines 2A—2A of FIG. 2.

An alternative means of assembly could involve edges 109' of molded sheet 100 as shown in FIG. 1 which is brought together along its length and interconnects along said edge 109' to allow the two sections 103 to merge as shown in FIG. 2A. In either method of assembly, the resultant brushware 100' has a three dimensional shape that is impossible to manufacture on ordinary brush and broom equipment. Other most important features are the conservation of the starting raw materials, and the fact that the brushware made in accordance with this instant invention is totally recyclable. Hygienic properties are imparted to this construction since there are no staple holes located on the brushware to attract or for bacteria to collect in, and a non-absorbing thermoplastic polymer is used so that no water or other chemical compounds can penetrate. The brushware article of this invention then is completely bacteria, mold and/or mildew resistant. The thin nature of the design also allows the brushware item to dry completely after use in a liquid medium. Brushware made in accordance with this invention is also dishwasher safe.

Figure 3:
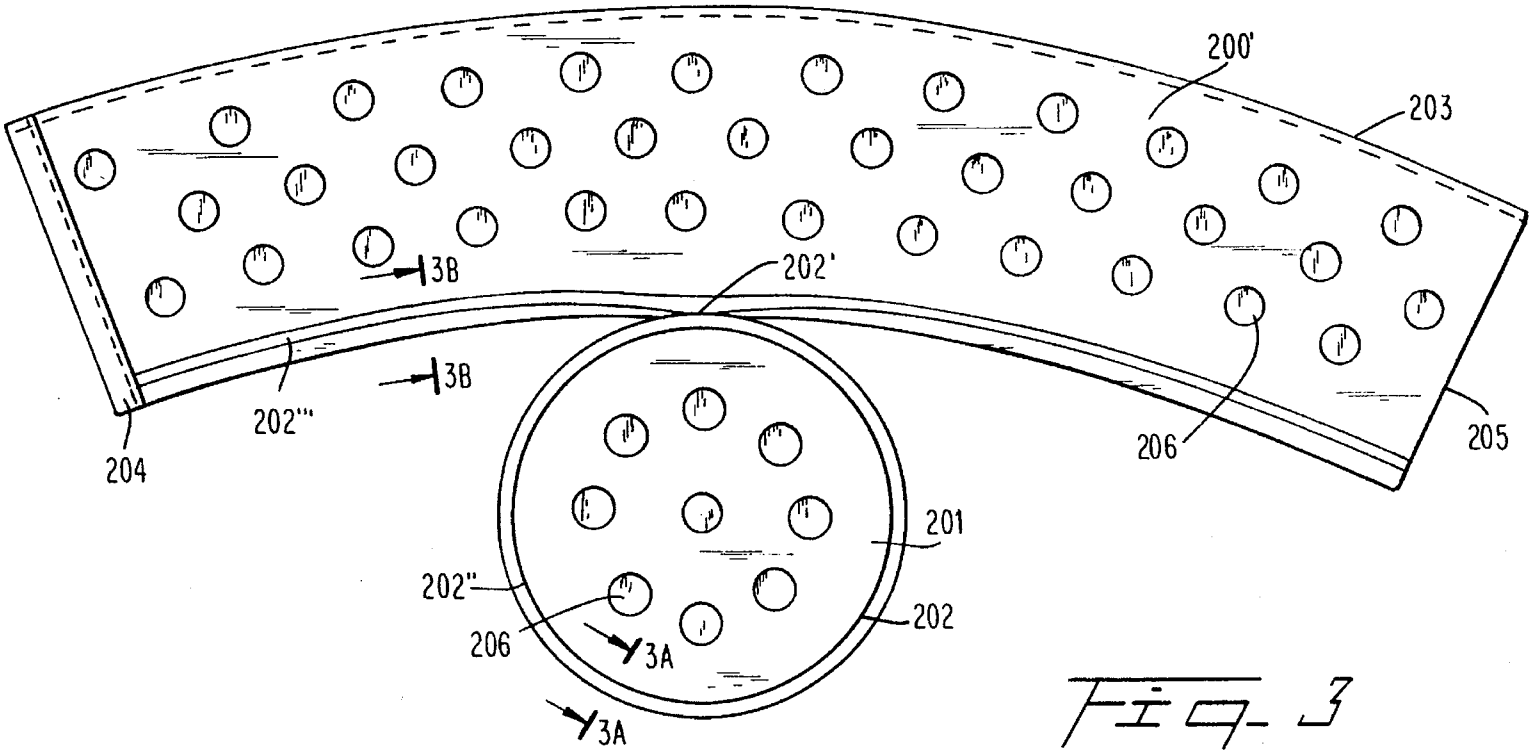
FIG. 3 is a top view of an unassembled one-plane molded handle/filament support member before fusing.
Figure 3B:
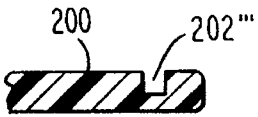
FIG. 3B is a cross-sectional view taken along lines 3B—3B of FIG. 3.
Figure 3A:
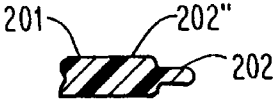
FIG. 3A is a sectional view taken along lines 3A—3A of FIG. 3.
Figure 5:
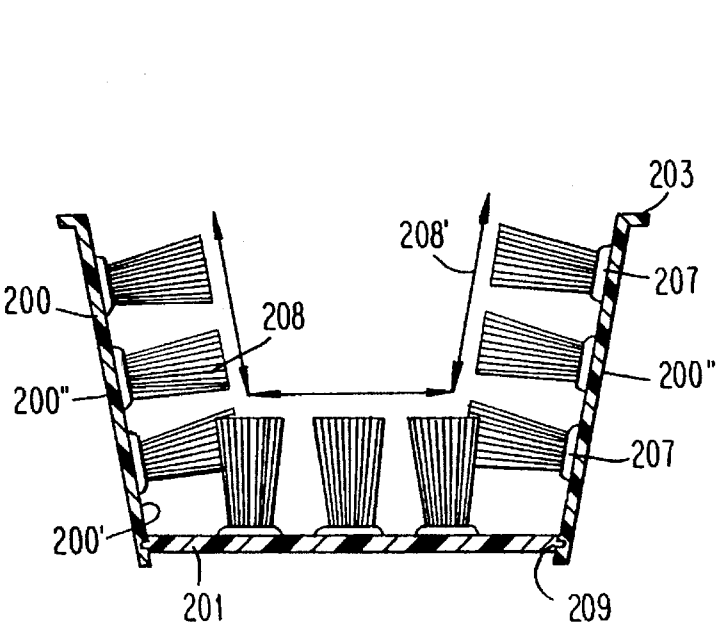
FIG. 5 is a cross-sectional view taken along lines 5—5 of FIG. 4.
Figure 4:
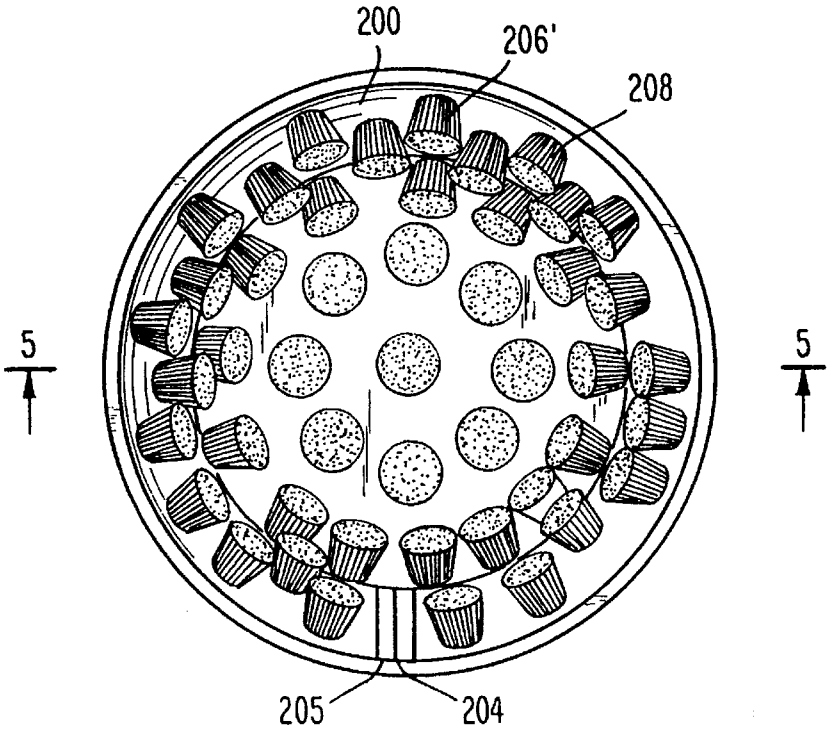
FIG. 4 is an assembled inside view of the fused molded handle/filament support of FIG. 3.

It is possible to design a one-piece fused, cup-shaped internally tufted brushware device utilizing the instant invention. FIG. 4 illustrates a cup brush 200 having fused filament tufts 208 as fused directly to tuft receiving projections 206 (FIG. 3) at 206'. The brushware device 200 becomes an inverted tufted device by first utilizing the molded one-piece configuration 200' having both configured filament accepting sections 200' and 201 integrally connected at 202' as shown in FIG. 3. Flat section 200' has a preconfigured top edge 203, while edges 202''', 204 and 205 possess edge connecting means in order to become attached to the edge 202 of filament accepting section 201. As shown in FIG. 4, the edges 204 and 205 form the means to fasten the circular tufted section 200' together to form the mat of inverted filament tufts 208. At the same time, the edges 202 and 202''' are joined together at 209 as shown in FIGS. 3A, 3B and 5 by allowing the projection means 202 located at 202'' to engage slot 202'''. FIG. 5 is a cross-sectional view of the tufted brushware device as taken through lines C—C of FIG. 4, illustrating the position of the tufts which form a perfect cup-like working surface. The cup brushware device 200 can be held in one's hand simply by grasping the outer wall 200''.

Figure 8:
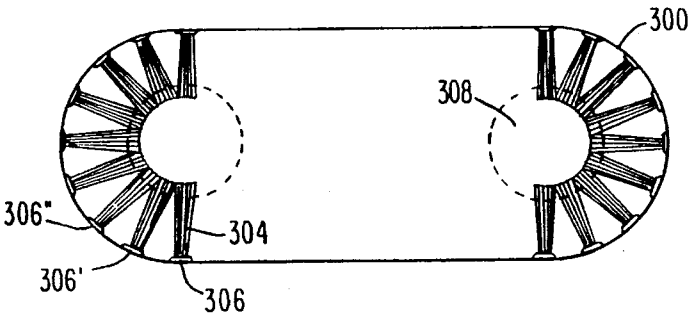
FIG. 8 is a cross-sectional view taken along lines 8—8 of FIG. 7.
Figure 7:
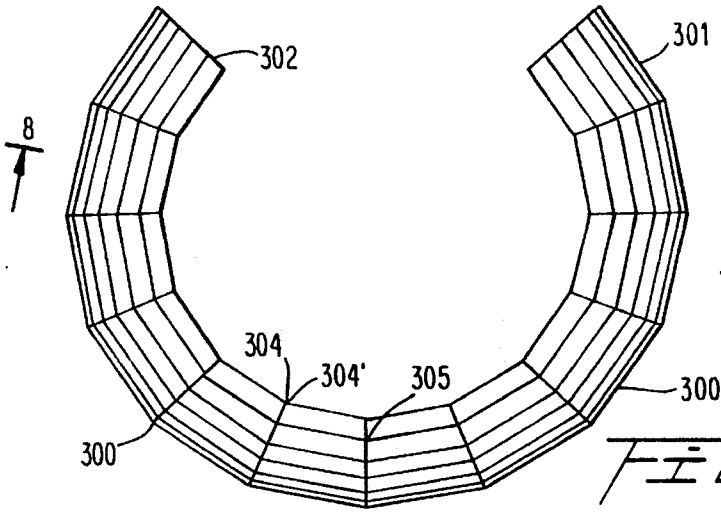
FIG. 7 is an assembled side view of the support member of FIG. 6.
Figure 6:
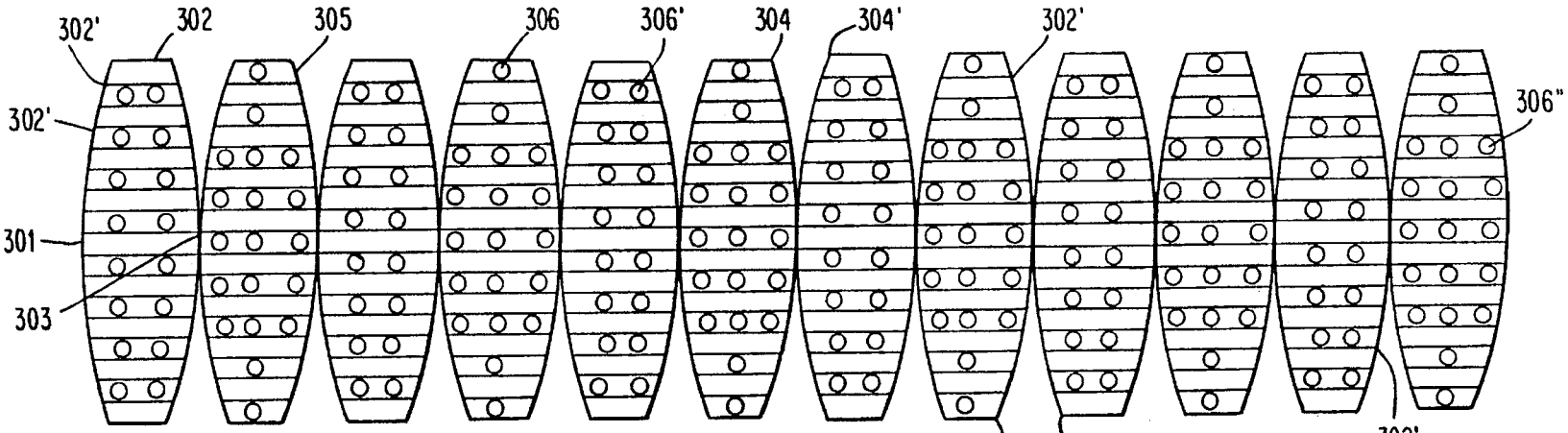
FIG. 6 is an unassembled view of a molded single-plane handle/filament support member prior to fusing.

A golf ball brushware washing device 300 which would be held within a mechanical means, such means not shown, consists of a premolded and configured sheet 301 integrally connected at 303 to repeating filament accepting sections 302 with pre-arranged filament designated areas 306, 306' and 306'' thereon as shown in FIG. 6. The sections 302 are molded in such manner as to have "living hinge" joints at 302', which allows the sections 302 to become a three dimensional configuration during assembly. Edges 304 and 304' become joined along the edge 305 during assembly as shown in FIG. 7. FIG. 8 illustrates the action the tufts 307 fused at 306, 306' and 306'' have on a golf ball 308 during the rotation of said ball 308 through the "C" shaped brushware device 300.

Figure 9:
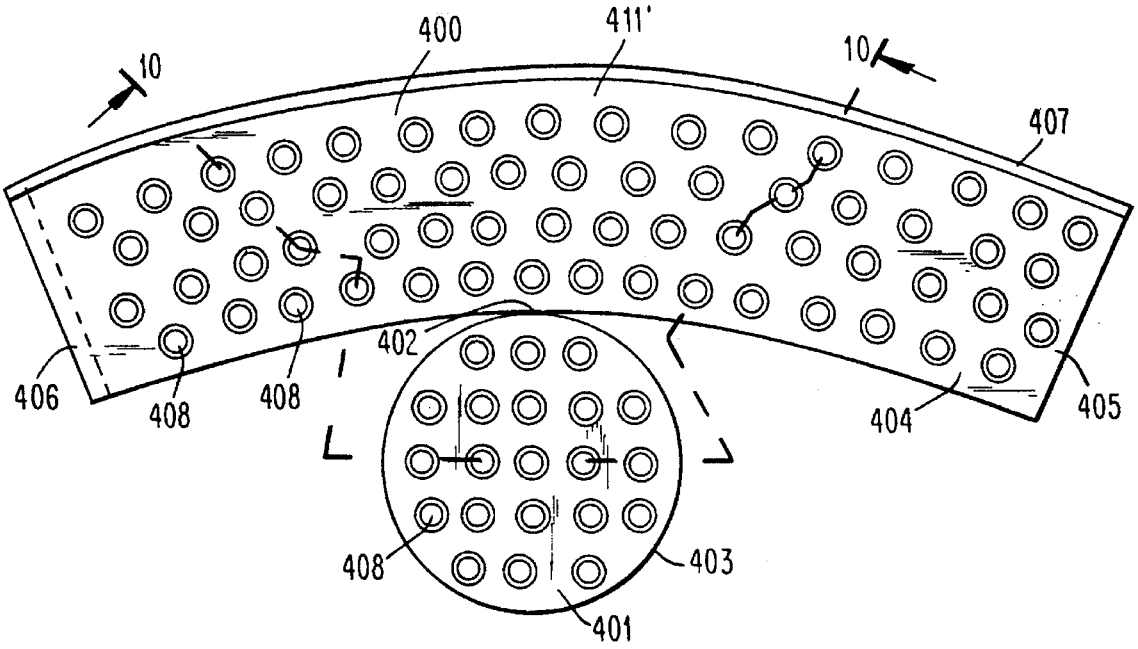
FIG. 9 is an unassembled single-plane molded brush support member.
Figure 10:
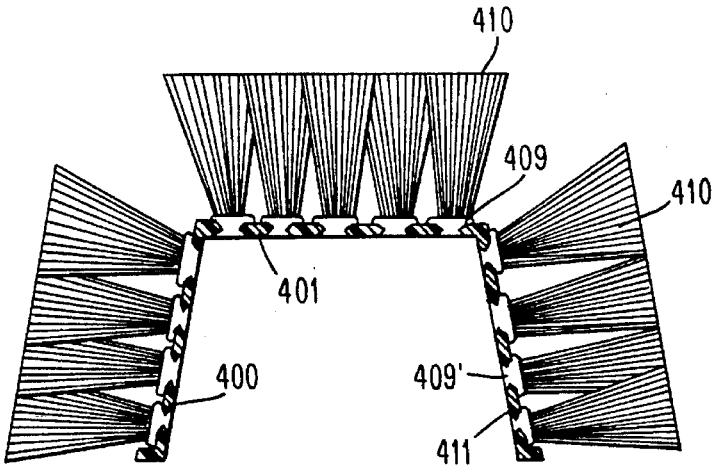
FIG. 10 is a cross-sectional view of the assembled device of FIG. 9 taken along lines 10—10 of FIG. 9.

FIGS. 9 and 10 illustrate a reverse cup-type brushware device 411 where the molded flat configured sheet is comprised of two sections, 400 and 401 respectively interconnected integrally at position 402, said position 402 being a "living hinge". Instead of having raised or level filament locating areas, there are disposed "through holes" 408 which accept the picked and fused end of filament tufts 410, and as illustrated in FIG. 10, the fused filament ends 409 result in a fused mass of thermoplastic 409' which is cooled and mechanically conforms and attaches to the molded opening 408. Thus, different materials, i.e. polypropylene and polyester, may be employed for the molded flat configured sheet and filament tufts respectively. One must realize, though, that the resultant brushware 411 produced with two different raw materials cannot be recycled as one material. The resultant brushware 411 has the same type of edge means for bringing together the original configured sheet 400, and is held together by affixing edge means 403, 404, 405 and 406.

Figure 13:
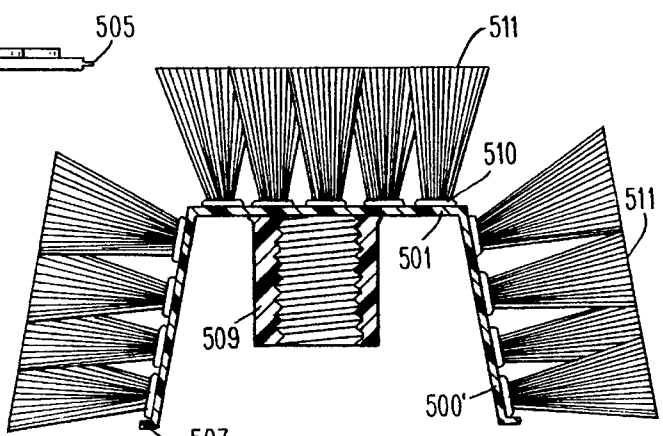
FIG. 13 is an assembled cross-sectional view taken along lines 13—13 of FIG. 11.
Figure 12:
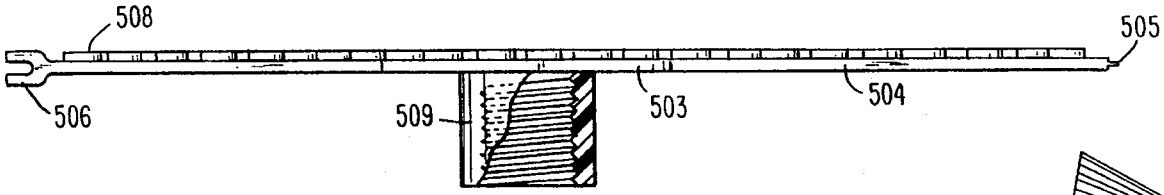
FIG. 12 is a side view of the unfused and unassembled molded support member of FIG. 11.
Figure 11:
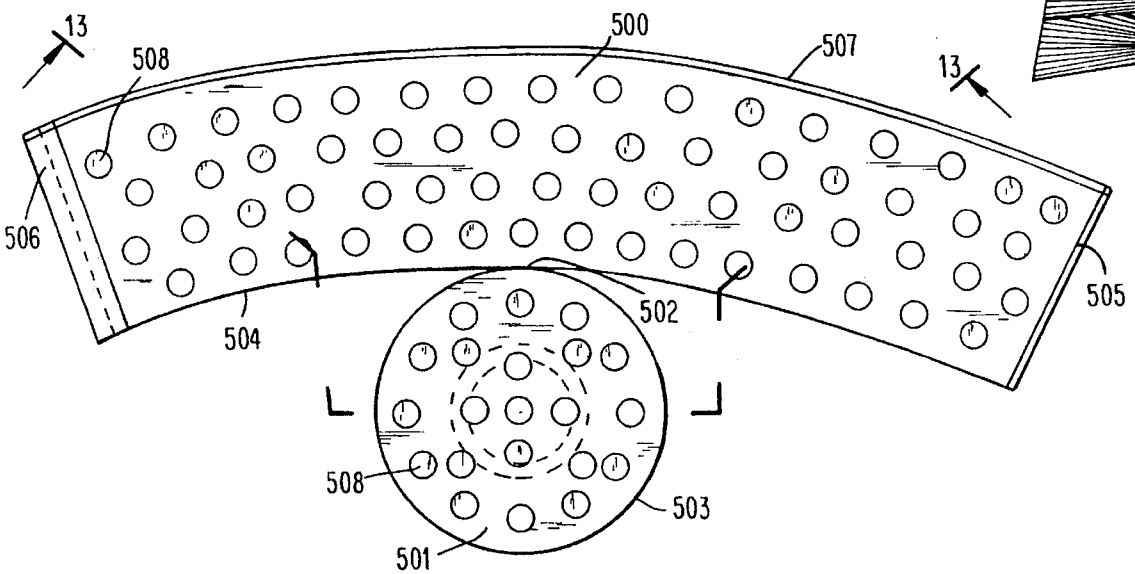
FIG. 11 is an unassembled top view of a single-plane molded brush tuft and integral support construction.
Figure 14:
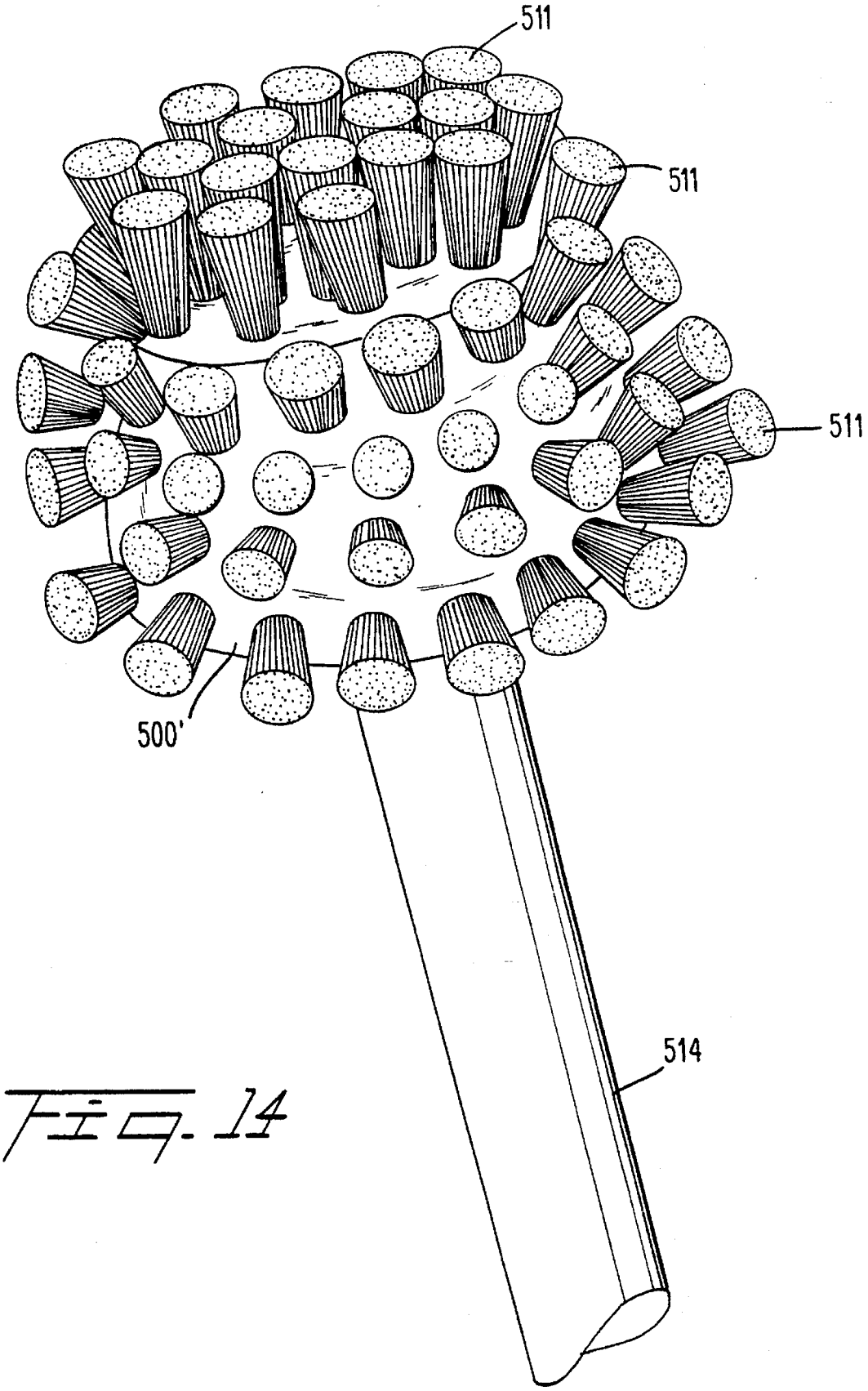
FIG. 14 is a perspective view of an assembled brush device of FIG. 11.

FIGS. 12 through 14 illustrate a modified handle cup brushware device 500' that can be obtained by molding a threaded means 509 integral with the original flat configured sheet sections 500 and 501 respectively and then treating the fusing of filament tufts as previously described onto filament areas 508 thus forming filament tufts 511 fused at position 510. After fusing the preconfigured tufts onto sheet sections 500 and 501, the resulting brushware unit 500' is assembled by bringing together edge means 503, 504, 505 and 506. The non-cooperating edge 507 may be configured with any rim shape necessary to impart added strength to the resultant brushware unit. FIG. 14 illustrates the brushware device 500' as mounted upon a wooden, metal or fiberglass handle. By configuring the two integrally joined filament sections 500 and 501, various slant degrees may be obtained in the resultant filament tufts, which would allow brushware to be designed to do a specific function.

Obviously, many modifications and variations of the instant invention are possible in light of the above teachings. The device may be made from polypropylene molded resin and fused synthetic polypropylene monofilament as the preferred material, however, other synthetic resins such as polyesters, polystyrenes, polyamides and the like may be employed. Filament diameters and cross-sectional shapes may also be varied, with diameters ranging from 0.005 through 0.050 inches and cross-sectional shapes from circular, "X", "Y" and other shapes, thus imparting different cleaning attributes within the mat structure.

The molded base sectional members may have a circular shape as well as any polygonal shape so long as it is possible to configure a three-dimensional space to accept a brush configuration. Either the upper or lower side of the molded surface may contain rib or structural fin-like projections in order to reinforce tufted surfaces for ultimate strength but not sacrifice the lightweight properties of the resultant brushware. There are unlimited brushware designs that can now be manufactured since there is no need to change the attitude or plane of the brush/broom block in order to affix the filament tufts thereon. Instantaneously picking and fusing of all the filament tufts in one plane and parallel filament arrangement prior to assembly into a three-dimensional brushware device can only be achieved by practicing the instant invention.

The molded base section is not limited to injection molding, but can be blow-molded as well, wherein a thin, integrally projecting configured sheet area is provided thereon and the blow-molded portion acts as a handle/container means for a liquid.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A preassembly tufted construction comprising:

a flat sheet of thermoplastic material including a first portion and a second handle portion, said first portion defined by first and second elongated sections, each section having a longitudinal curved edge, said sheet having a first surface mounting a plurality of mutually spaced integral monofilament tufts disposed at preselected sites on said sheet, said tufts covering at least part of the first portion of said sheet, a second surface of said sheet opposite the first surface being flat; and means carried by said first and second sections, at least at said curved edges, for assembly of the same into a three dimensional arcuate tufted construction by joining said edges of said first and second sections with said second handle portion such that said tufts extend radially from said first portion.

2. The construction of claim 1 wherein said tufts and sheet are of the same thermoplastic material.

3. The construction of claim 1 wherein the first surface of said sheet has raised sites located thereon which join said nonworking ends of said tufts to said first surface.

4. The construction of claim 1 wherein said means includes a projection molded on said second surface of said sheet and at least one hole provided in each said section for receiving said projection.

* * * * *